US009861554B2

(12) United States Patent
Ammar

(10) Patent No.: US 9,861,554 B2
(45) Date of Patent: Jan. 9, 2018

(54) TIME-INDICATING MEDICATION BOTTLE

(71) Applicant: Karen S. Ammar, Hollywood, FL (US)

(72) Inventor: Karen S. Ammar, Hollywood, FL (US)

( * ) Notice: Subject to any disclaimer, the term of this patent is extended or adjusted under 35 U.S.C. 154(b) by 0 days.

(21) Appl. No.: 14/475,554

(22) Filed: Sep. 2, 2014

(65) Prior Publication Data

US 2015/0060387 A1 Mar. 5, 2015

Related U.S. Application Data

(60) Provisional application No. 61/872,834, filed on Sep. 2, 2013.

(51) Int. Cl.
*A61J 1/03* (2006.01)
*A61J 7/04* (2006.01)

(52) U.S. Cl.
CPC . *A61J 1/03* (2013.01); *A61J 7/04* (2013.01); *A61J 2200/30* (2013.01)

(58) Field of Classification Search
CPC .. A61J 7/04; A61J 1/03; A61J 2200/30; G09F 11/24; G09F 11/23; B65D 55/026; B65D 51/245; B65D 2203/00
USPC ..... 215/230; 206/534, 459.1; 116/308
See application file for complete search history.

(56) References Cited

U.S. PATENT DOCUMENTS

| | | | | | |
|---|---|---|---|---|---|
| 2,450,949 | A * | 10/1948 | Gattuccio et al. | 116/308 |
| 2,739,564 | A * | 3/1956 | North | 116/308 |
| 2,767,680 | A * | 10/1956 | Lermer | 116/308 |
| 3,349,935 | A * | 10/1967 | Cochin | 215/221 |
| 3,818,858 | A * | 6/1974 | Kramer et al. | 116/308 |
| 4,548,157 | A * | 10/1985 | Hevoyan | 116/308 |
| 4,802,438 | A * | 2/1989 | DeJonge | 116/308 |
| 4,877,119 | A * | 10/1989 | Hosking | 206/459.1 |
| 5,482,163 | A * | 1/1996 | Hoffman | 206/534 |
| 5,662,224 | A | 9/1997 | Nogues | |
| 6,068,149 | A | 5/2000 | Telega | |
| 6,089,180 | A * | 7/2000 | Nichols, Jr. | 116/309 |
| 7,222,736 | B1 | 5/2007 | Seijas | |
| 7,665,611 | B2 * | 2/2010 | Koch | 206/534 |
| 7,857,134 | B2 * | 12/2010 | Koch | 206/534 |
| 8,534,220 | B1 * | 9/2013 | Olson | 116/309 |
| 2006/0180566 | A1 * | 8/2006 | Mataya | 215/230 |
| 2011/0284415 | A1 * | 11/2011 | Balakier et al. | 206/459.1 |
| 2014/0008319 | A1 * | 1/2014 | Buxton-Dakides | 215/230 |

* cited by examiner

*Primary Examiner* — Steven A. Reynolds
(74) *Attorney, Agent, or Firm* — Fleit Gibbons Gutman Bongini Bianco PL; Jon A. Gibbons

(57) ABSTRACT

A medication bottle includes: a bottle having a body and a neck; a set of indicia disposed on a surface of the body; a timing ring having detent features on an inner ring surface, the detent features configured to fit onto the neck; a time indicator manually positionable proximate a selected indicium by rotating the timing ring about the neck; and a cap removably attached to the neck.

7 Claims, 2 Drawing Sheets

TIME-INDICATING MEDICATION BOTTLE

FIELD OF THE INVENTION

The present invention generally pertains to medication bottles and more particularly to medication bottles that provide indicia reminding users when their medication should next be taken.

BACKGROUND OF THE INVENTION

People who must take medication several times each day to regain or maintain good health may have trouble remembering how many hours have passed since their last dose and/or how many hours until their next dose should be taken. Especially as people age, their memory may remain accurate with respect to events of long ago but may become very inaccurate with respect to recent events, such as the time they took their last medication. As a result, some people may take their medication too often, while others may not take it often enough.

One of the most common attempts to solve this problem involves creation of a device that may attach to a medication bottle and provide the ability to indicate when the next dose should be taken. U.S. Pat. No. 7,222,736 issued to Seijas discloses a reminder device that may be attached to the bottom of a medication bottle and adjusted to reflect a future time when the next dose of medication should be taken. U.S. Pat. No. 6,068,149 issued to Telega discloses a cap that may be attached to a bottle and adjusted to remind a user when the next dose of medication should be taken. U.S. Pat. No. 5,662,224 issued to Nogues discloses a ring that may fit over a medication bottle and has available settings from one to twelve to indicate the time of the next dose. All of these devices, however, are separate devices from an actual medication bottle and must be purchased and installed separately on each medication bottle in use.

It would therefore be advantageous to have a medication bottle that does not require installation of a separate device to indicate when medication should next be taken. Such a medication bottle may contain an imprinted set of numbers, in large font easily visible even by those with poor vision, representing hours when medication should be taken. Such a bottle may also contain a permanent indicator that is part of the bottle's design and can be adjusted to indicate the desired number within the imprinted set of numbers or other indicia.

SUMMARY OF THE INVENTION

The present invention overcomes the disadvantages and limitations of the prior art by providing a medication bottle that contains an imprinted set of numbers or indicia, in large font easily visible even by those with poor vision, representing hours when medication should be taken. Such a bottle may also contain a permanent time indicator that is part of the bottle's design and can be adjusted to indicate a desired number within the imprinted set of numbers or idicia.

The present invention may therefore comprise a bottle to contain medication prescribed by a medical professional, comprising: a bottle having a body and a neck; a set of numbers or indicia on the outside of the body of the bottle; a timing ring with detent features around its inner surface that fit tightly over the neck of the bottle and with an hour indicator that may be manually adjusted to indicate the hour when medication in the bottle should next be taken; and a cap that attaches to the neck of the bottle and fits over the inner surface diameter of the timing ring so as to retain the timing ring and the time indicator on the body and the neck of the bottle.

The set of numbers may be imprinted into or embossed onto the outside of the body of the bottle, as is known in the art, and may comprise the set of integers from one to twelve, inclusive.

The advantage of the present invention is that the indicia used to show the time of a future medication dose is combined into the bottle without the necessity of purchasing and installing a separate device.

DETAILED DESCRIPTION OF THE INVENTION

Figure 1:
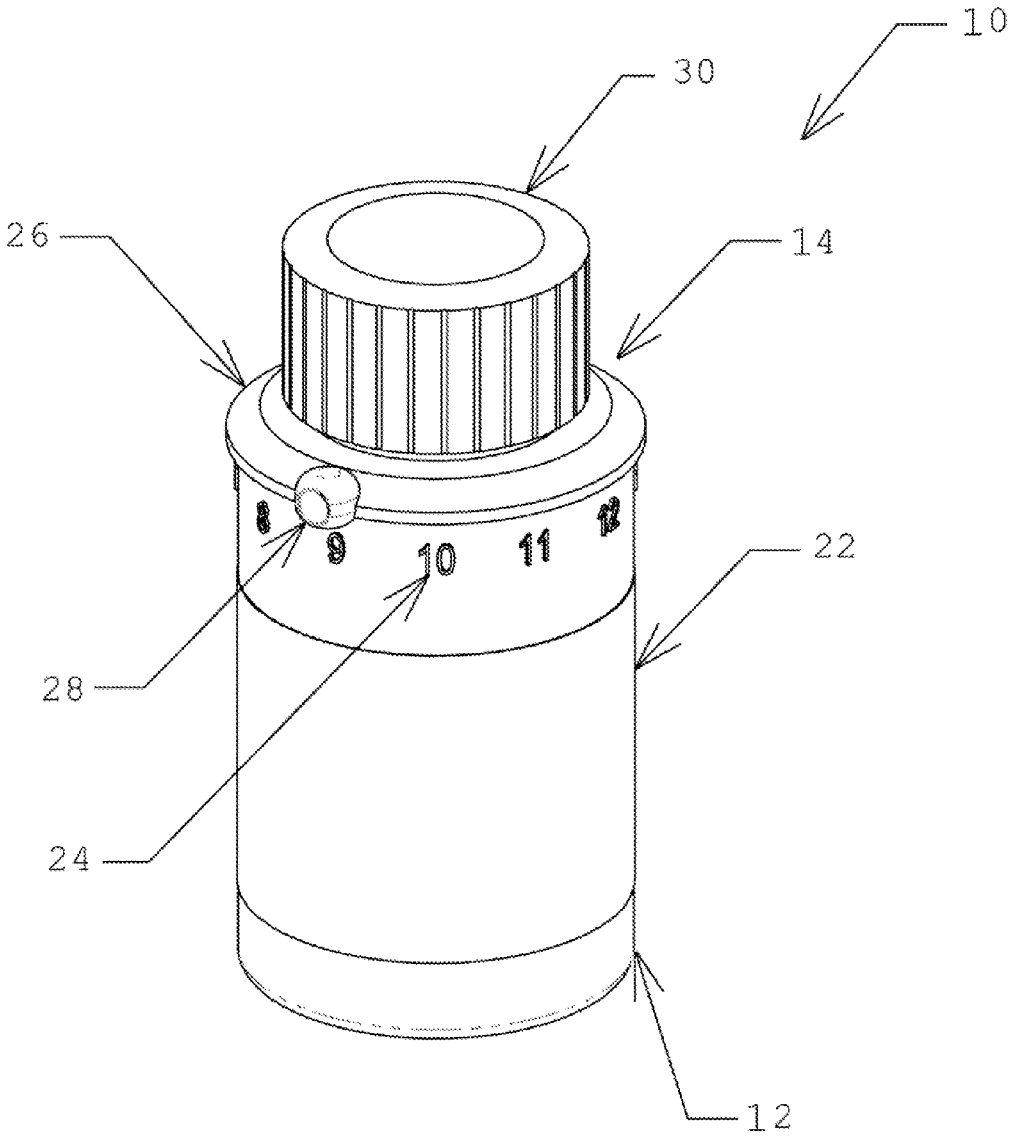
FIG. 1 is an isometric schematic representation of a medication bottle with a timing ring, in accordance with an aspect of the present invention.

FIG. 1 illustrates a schematic representation of one embodiment of the present invention. The present invention is a time-indicating medication bottle 10 comprising a bottle 22 having a bottle body 12 and a bottle neck 14, as is known in the art. The time-indicating medication bottle 10 further comprises a set of indicia 24, a timing ring 26, an outwardly-protruding time indicator 28, and a cap 30. The bottle neck 14 is configured to provide for removably attaching the cap 30 to the bottle body 12 such as, for example, by using a threaded interface, by using a snap-on-snap-off feature, or by using a squeeze-and-turn operation, as is known in the art. The timing ring 26, with the protruding time indicator 28, is removably disposed on the bottle neck 14.

In an exemplary embodiment, the body 12 of the bottle 22 may have a round cylindrical shape as commonly used for medication bottles, although a bottle with a rectangular cross sectional shape may also be used. The upper region of the body 12 of the bottle 22, that is, the region proximate the neck 14, may be permanently marked with the set of indicia 24 that, in the example provided, includes integers from one to twelve, to thus represent a twelve-hour clock cycle.

The time indicators that are part of the set of indicia 24 may be imprinted into or embossed onto the upper surface region of the plastic or other material that makes up the body 12 of the bottle 22 and may be evenly spaced around the outside surface of the body 12 of the bottle 22. It can be appreciated that the time indicators may alternatively include: (i) numbers from one to twenty four, for 24-hour time cycles; (ii) the numbers from one to thirty one, to indicate dates; or (iii) the letters S-M-T-W-T-F-S for use in weekly cycles. The neck 14 of the bottle 22 may have a smaller diameter than the body 12 of the bottle 22 to provide a more pleasing design.

The cap 30 may be placed onto and secured or tightened about the neck 14 of the bottle 22, the cap 30 thus being placed over the timing ring 26. The cap 30 may be moderately tightened, or otherwise secured, in a fashion that will keep the bottle 22 closed when not in use. When thus properly secured, the cap 30 does not: (i) affect the position of the timing ring 26, or (ii) make the bottle 22 difficult or impossible to open for patients who may lack both dexterity and strength.

Figure 2:
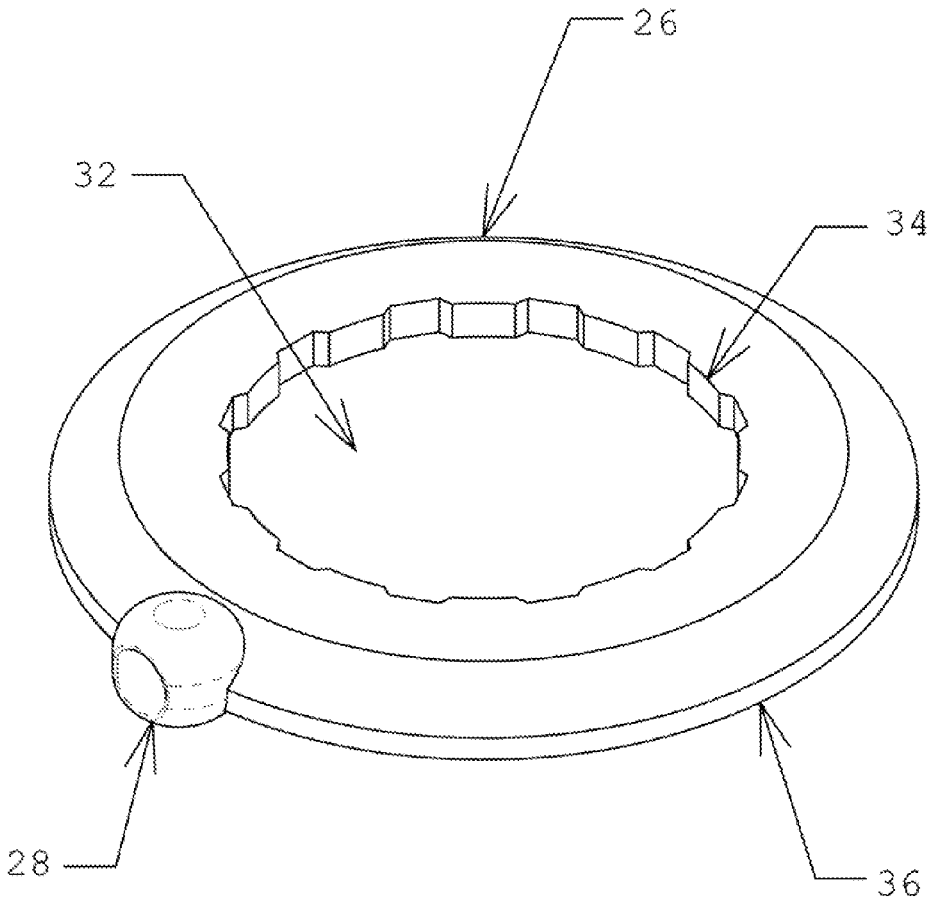
FIG. 2 is an isometric view of the timing ring of FIG. 1.

FIG. 2 is an isometric view of one embodiment of the timing ring 26. The inner ring surface 32 of the timing ring 26 is configured with a plurality of inwardly-protruding detent features 34 disposed on the inner ring surface 32. The detent features 34 are inwardly-protruding to enable the timing ring 26 to fit over the neck 12 of the bottle 22 when the cap 30 is in place, and limit rotation of the timing ring 26, without the likelihood of inadvertent removal of the timing ring 26 from the time-indicating medication bottle 10. It can be appreciated by one skilled in the art that the outer diameter of the cap 30 is larger than the diameter of the inner surface 32 of the timing ring 26 such that, when tightened or secured, the cap 30 limits or prevents movement of the timing ring 26 about the bottle neck 14.

The time indicator 28 may be configured as a small knob attached to and protruding from the outer circumference 36 of the timing ring 26. By using the time indicator to manually rotate the timing ring 26 around the body 12 of the bottle 22, a user can set the time indicator 28 proximate any indicium in the set of indicia 24. In this way, the selected indicium may serve to indicate to the user, for example, either the last time that medication in the bottle 22 was taken, or the next time that medication in the bottle 22 should be taken.

The present invention therefore provides a medication bottle with a user-operated, rotatable mechanism for indicating at what hour or date medication should next be taken (or was last taken) and an easily visible set of indicia, with each indicium displaying a possible hour or date to the user. Such a medication bottle may be used as part of a method of improving patient health by preventing overmedication or under-medication.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A time-indicating bottle, comprising:

a bottle having a body and a neck;

a set of indicia disposed on an upper surface region of the body;

a timing ring having a plurality of detent features disposed on an inner surface of the timing ring, the detent features configured to fit over the neck proximate the set of indicia;

an outwardly-protruding time indicator attached to the timing ring, the outwardly-protruding time indicator manually positionable proximate an indicium of the set of indicia by rotating the timing ring about the neck; and a cap removably attached to the neck, the cap having an outer diameter larger than a diameter of the inner surface of the timing ring such that, when tightened onto the bottle, the cap limits rotation of the timing ring about the neck.

2. The time-indicating bottle of claim 1, wherein the set of indicia is imprinted onto the upper surface region.

3. The time-indicating bottle of claim 1, wherein the set of indicia is embossed on the upper surface region.

4. The time-indicating bottle of claim 3, wherein the set of indicia includes a set of integers from one through twelve.

5. The time-indicating bottle of claim 1, wherein the detent features include inwardly protruding features disposed on the inner ring surface of the timing ring.

6. The time-indicating bottle of claim 1, wherein the outwardly- protruding time indicator is shaped as a knob.

7. The time-indicating bottle of claim 6, wherein the knob is attached to and protrudes from an outer circumference of the timing ring.

* * * * *